United States Patent [19]

Bubley

[11] 4,442,772

[45] Apr. 17, 1984

[54] SCREEN TENSIONING APPARATUS

[75] Inventor: Henry J. Bubley, Deerfield, Ill.

[73] Assignee: American Screen Printing Equipment Company, Chicago, Ill.

[21] Appl. No.: 436,855

[22] Filed: Oct. 26, 1982

[51] Int. Cl.[3] ..... B05C 17/08

[52] U.S. Cl. ..... 101/127.1; 101/415.1

[58] Field of Search ..... 101/127, 127.1, 128, 101/128.1

[56] References Cited

U.S. PATENT DOCUMENTS

| | | | |
|---|---|---|---|
| 3,176,843 | 4/1965 | Hoskins et al. | 101/127.1 X |
| 3,414,994 | 12/1968 | Jaccard et al. | 101/127.1 X |
| 3,422,554 | 1/1969 | Prinzhorn | 101/127.1 X |
| 3,608,482 | 9/1971 | Bubley | 101/127.1 |
| 3,608,484 | 9/1971 | Bubley | 101/127.1 |

OTHER PUBLICATIONS

*Cincinnati Printing and Drying Systems Inc.* Advertisement for "Screen Stretching Clamps," published 11-5-71.

*Primary Examiner*—Edgar S. Burr
*Assistant Examiner*—John A. Weresh
*Attorney, Agent, or Firm*—Fitch, Even, Tabin & Flannery

[57] ABSTRACT

In the preparation of screen process stencils a stencil frame is enclosed tightly by a pneumatically operated frame. Once the stencil frame is enclosed the pneumatic tensioning frame is inflated pulling a screen fabric outwardly to stretch the same with a concomitant vertical movement of the frame member and frame supporting portion of the tensioning frame so that the top wall of the frame member is pushed tightly and intimately against the underside of the screen fabric thereby promoting the desired adhesion between the fabric and the frame. This is achieved inexpensively in the present invention by providing a support means which supports the screen tensioning device at a predetermined angle to the horizontal so that with movement of the fabric carrying portion outwardly away from the stencil frame, the frame support portion is being raised and is lifting the side frame member upwardly against the underside of the screen fabric.

9 Claims, 3 Drawing Figures

SCREEN TENSIONING APPARATUS

This invention relates to screen tensioning apparatus and more particularly to apparatus for stretching fabrics such as silk screen printing fabrics over a frame.

The present invention is directed to and is an improvement over the pneumatic screen tensioning device shown in U.S. Pat. Nos. 3,541,957 and 3,608,484 which are assigned to the assignee of this invention and which are incorporated herein by reference as if fully reproduced herein.

The pneumatic screen tensioning devices shown in the aforesaid patents operate generally satisfactorily and are in wide spread use.

However, it has been noted that with the advent of metal frames in screen printing applications, there is a need to obtain greater tension on the screen and also to make more intimate or tighter contact between the screen printing frame and the screen during the gluing operation, That is, with the typical lightweight metal frames usually formed of aluminum extrusions, or the like, it is preferred that the screen be pulled across the top surfaces of the frame members and be held under pressure thereagainst while being attached by an adhesive such as a glue or an epoxy adhesive.

The present invention is not to be construed as being limited to any particular screen printing frame whether it is made of metal or wood and whether or not the screen is attached by various fastening devices including nails, staples, or other mechanical fasteners, as well as adhesives.

As disclosed in U.S. Pat. No. 3,608,484, the existing pneumatic tensioning devices use an internal, inflatable air bar or tube which forces a slidable fabric carrying portion of the tension device outwardly from the screen frame in a horizontal plane parallel to the screen frame. The other portion of the pneumatic screen tensioning device of U.S. Pat. No. 3,608,484 has a flange or lugs underlying the bottom of the screen frame and a vertical wall abutting a vertical side of the screen frame with the support portion being generally stationary as the air bar forces the fabric carrying and sliding portion outwardly in a horizontal plane to stretch the fabric. It has been noted that this apparatus had a tendency to lift the screen fabric slightly away from the frame which detracts from the desired tight engagement of the screen fabric with the frame during the adhering process. Also, there was a slight tendency for the screen tensioning device to pivot slightly upwardly at its rear outward end relative to the lugs engaging the screen frame member which also tends to lift the screen fabric from the frame member. This upward pivoting action tends to increase with increased air pressures; and hence, the air pressure used was limited to abut 12 and 13 pounds psi to limit this upward pivotal movement with this patented device.

Accordingly, a general object of the invention is to provide a new and improved screen tensioning apparatus.

These and other objects and advantages of the invention will become apparent from the following detailed description taken in connection with the accompanying drawings and which:

Figure 1:
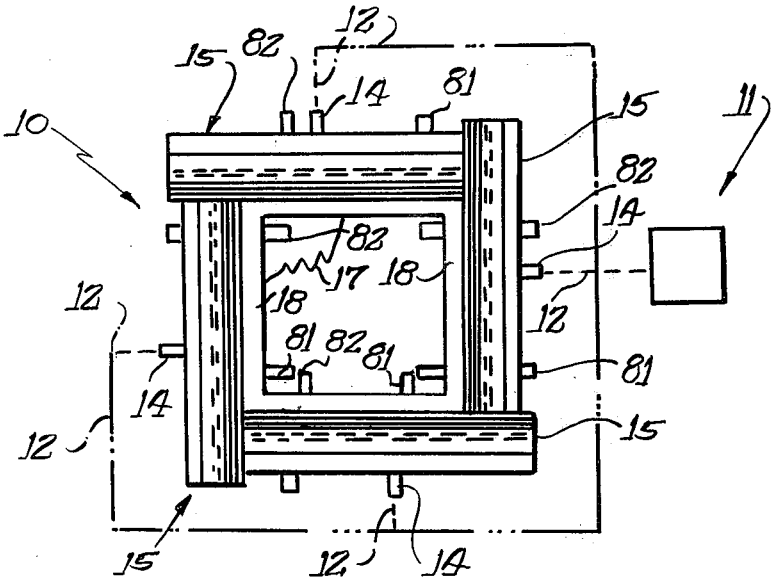
FIG. 1 is a view of a screen printing apparatus in plan construed in accordance with the preferred embodiment of the invention.

As shown in the drawings for purposes of illustration, the invention is embodied in a silk screen printing apparatus 10 which is operated by a power means preferably a fluid power means in the form of a pneumatic means 11 which includes suitable air hoses or conduits 12 extending to suitable air inlets ports 14 to each of the respective four screen tensioning devices 15 which are disposed about the four sides of the screen printing frame 17. Typically, the screen printing frames are quadlateral in shape, and are composed of four side frame members 18, each of which is substantially in identical construction and which in this instance by way of example are made of thin metal aluminum extrusions such as shown in co-pending application Ser. No. 389,174, filed June 17, 1982.

The internal construction of the respective pneumatic tensioning devices 15 is substantially identical to that disclosed in U.S. Pat. No. 3,608,484 and hence, need not be repeated herein in such detail. Very briefly, the pneumatic tensioning device comprise a first frame supporting portion 25 which engages the frame and support the frame member during the stretching of a fabric 26 which is attached to a slidable fabric second portion 30. The outer fabric slidable portion 30 is the external or outer portion of the tensioning device which slides outwardly from the side frame member 18 when an internal air bar or tube 32 is expanded by the compressed air flowing through the hoses 12 and through the inlet ports 14 connecting to the interior of the tube.

Figure 2:
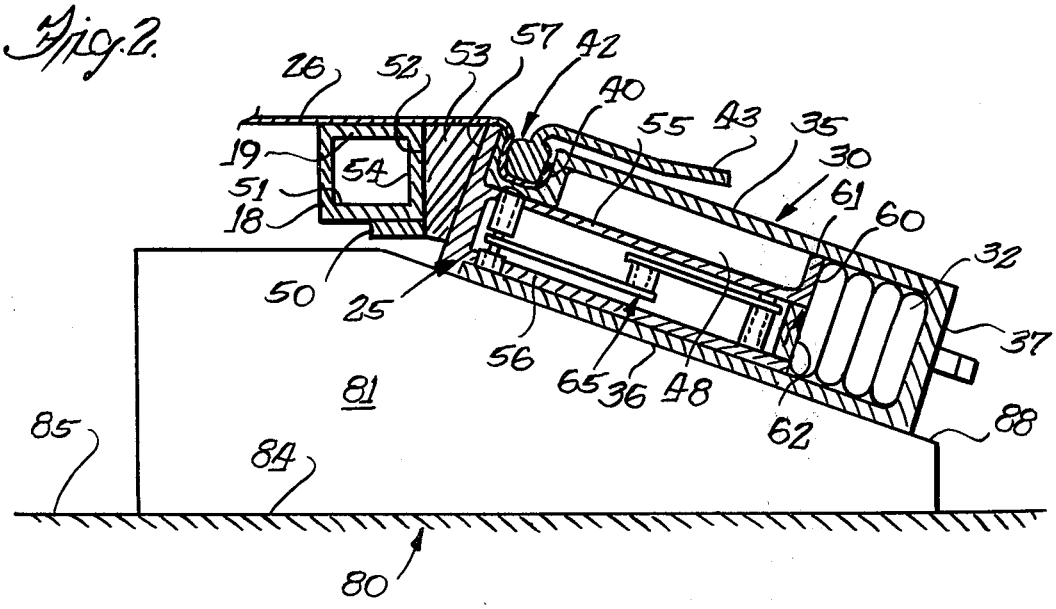
FIG. 2 is a cross sectional view showing the inclination of the screen tensioning device when mounted in accordance with the preferred invention.

The outwardly slidable fabric portion 30 is in the form of a general hollow chamber or casing defined by an upper flat chamber wall 35 (FIG. 2) spaced from and parallel to a lower flat chamber plate wall 36. These flat plate walls 35 and 36 are joined at their outward ends by a vertical end wall 37. At the opposite forward end, the upper plate wall 35 is formed with the fabric receiving groove or channel 40 which runs along the front of the tensioning device to receive the fabric edge therein and which is locked therein by a pivotal cam lock bar 42 as is fully described in U.S. Pat. No. 3,608,484. This is, the fabric is laid in the groove 40 and the lock bar is placed over the fabric and then a handle 43 on the lock bar is pivoted down to lock the fabric in the groove 40 and to the slidable portion 30.

The first frame support portion 25 of the tensioning device 15 is mounted within the hollow interior or chamber 48 of the fabric carrying portion 30 for sliding and includes a forward frame engaging flange 50 which underlies lower wall 51 of the side frame member 18. A vertical bar 53 on the frame support portion 50 extends upwardly from the flange 50 with a vertical side 52 abutting a vertical side wall 54 of the side frame 18. The bar 53 is generally wedge shape in cross section to provide the vertical wall 52 and to hold the lugs 50 attached thereto in horizontal plane. The rear wall of the wedge shaped bar is inclined to the vertical and is fastened to a front, vertical plate 57 on frame support section 25. The wedge shape bar 53 has no counterpart in the tensioning device of U.S. Pat. No. 3,608,484 because the plate 57 was not inclined and because the horizontal lugs 50 were attached directly to the plate 57.

Turning now to the internal construction of the frame support portion 25, it includes a pair of parallel plates 55 and 56 projecting inwardly within the hollow chamber 48 of the other fabric carrying portion 30. That is, integrally formed and projecting at right angles from the front plate 57 are the internal parallel plates 55 and 56 which have sliding engagement with the fabric portion as will be described hereinafter. The parallel 55 and 56 extend inwardly to an upper projecting flange 60 having an upper surface 61 for sliding against the undersurface of the wall 35 when the latter moves outwardly to the right under the pressure of the expanding air bar 32. The end wall 60 and a removable end wall 62 therebelow which extends to the lower plate 56 abut the left side of the air bar which has its folded pneumatic tube also abutting the end wall 37 at the right hand end thereof.

Figure 3:
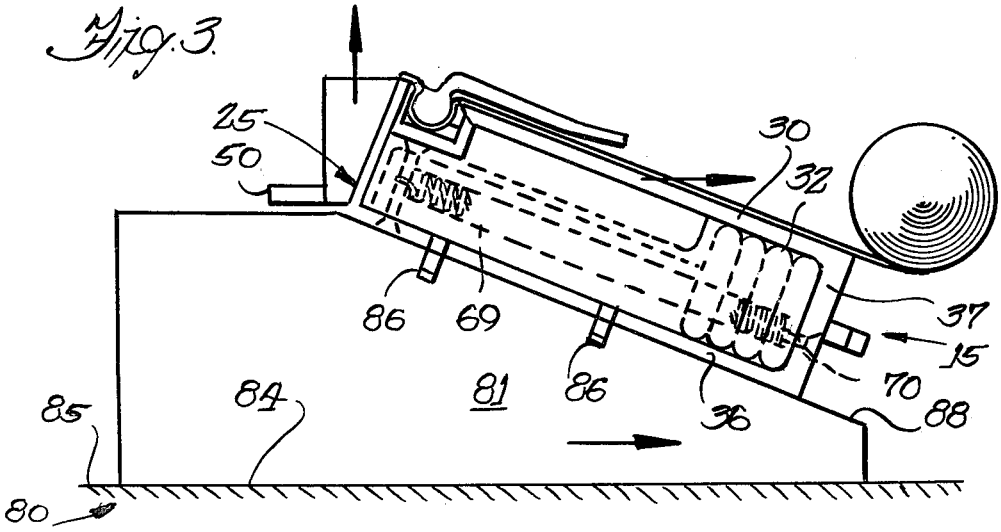
FIG. 3 is a diagramatic illustration of the lifting of the frame support portion of the tensioning device and the lifting of the frame as the fabric is being stretched.

A parallel linkage device 65 is mounted between the plates 55 and 56 and serves to guide the first and second portions 25 and 30 for parallel sliding movement as described in the aforesaid patent. Likewise, as shown in the aforesaid patent, and as illustrated in FIG. 3, internal springs 69 have forwarded ends connected to the frame member and have outward or right spring ends connected to a spring hook 70 fastened to end wall 37 of the slidable fabric member. The spring 69 is a contract spring which will return the fabric member to the left when the air pressure is removed causing a collapse of the air bar 32.

In the above-described tensioning mechanism, as shown in U.S. Pat. No. 3,608,484, the bottom wall 36 of fabric member slid across a horizontal surface when the air bar was pressurized and as it does so there was a tendency for the internal play or tolerances to be taken up with the outer end wall 37 of the fabric carrying portion tending to lift slightly which has a tendency to lift the fabric 26 from the top wall 19 of the side frame member 18. Likewise, in this patented device, the forces being exerted has a tendency, as the sliding fabric member moved horizontally and outwardly to cause a pivoting action of the tensioning device about the lower lugs 50 which further tended to reduce the contact between the screen fabric 26 and the top wall 19 of the side frame member 18. With the use of mechanical fasteners or other devices to secure the fabric to the side member, the lifting of the fabric was not so much as a problem as with the use of adhesives to secure the fabric 26 to a metal top wall 19 of the frame member 18.

In accordance with the present invention there is provided a new and improved method and apparatus for pulling the fabric 26 outwardly to stretch the same with a concomitant vertical movement of the second portion 25 and the frame member 18 so that the top wall 19 of the frame member is pushed tightly and intimately against the underside of the screen fabric 26 thereby promoting the desired adhesion between the fabric and the frame. This is achieved inexpensively in the present invention by providing a support means 80 which supports the screen tensioning device 15 at a predetermined angle to the horizontal so that with movement of the fabric carrying portion 30 outwardly to the right as viewed in the FIG. 3, the frame support portion 25 is being raised and is lifting the side frame member 18 upwardly against the underside of the screen fabric 26.

The preferred support means 80 comprises a pair of support legs 81 and 82, as best seen in FIG. 1, each of which has a lower wall or surface 84 for sliding along a horizontal support or table 85 with the movement of the fabric movable portion 30. Herein mechanical fasteners or other devices 86 (FIG. 3) interconnect the bottom wall 36 of the fabric movable portion 30 to an inclined wall 88 on the support legs 81 and 82. When the expandable air bar 32 expands against the end wall 37 of the fabric carrying portion 30 the latter moves to the right and slides the legs 81 and 82 outwardly to the right along the horizontal table 85. The table 85 prevents the downward movement of the legs 81 and 82 and of the fabric carrying portion 30, so that the rightward movement thereof causes the engaged inclined surfaces between the portions 25 and 30 forces the upward movement of the portion 25 and side frame member 18 on lugs 50 against the underside of the fabric 26. That is, as the inclined lower plate wall 36 of the fabric portion 30 moves horizontally to the right, the facing sliding plate 56 of the frame carrying portion 25 is being forced upwardly and this raises the frame member 18. The amount of vertical lift of the lugs 50 relative to horizontal movement of the legs 81 is geometrically related to the angle of inclination of the tensioning device to the horizontal. It is this relative vertical movement with the simultaneous outward stretching of the fabric 26 which causes the tight intimate contact between the fabric 26 and the top surface 19 of the screen frame member 18. The greater the outward stretching movement, the greater the lifting of the side frame member and the more tight intimate contact therebetween. Whereas, heretofore, the air pressure of 12 to 15 pounds cause a lifting of the fabric from the side frame member, it is now easy with the present invention to use 25 or 30 psi as may be desired.

The angle used in the preferred and illustrated embodiment invention is 20 degree to the horizontal. From the foregoing it will be seen that the present invention provides means to shift the screen frame member 18 vertically while the fabric is being stretched outwardly across the frame member. The vertical movement forces a tight and intimate engagement between the screen fabric 26 and the frame member 18. The outward pull could be thought of as pretensioning of the fabric with the vertical movement of the screen frame bar as a further tensioning of the fabric. Preferably, both movements are occurring simultaneously so that there is a good tensioning from the outward movement of the fabric as well as from the uuward movement of the bar against the fabric.

It is to be understood that in the usual screen stretching and fastening operation that four screen printing devices 15 are used on each of the four sides and are all operated simultaneously if all four tensioning devices 15 are not operating simultaneously then it is usual practice to operate an opposing pair to cause the fabric to be stretched across opposite side frame members 18.

While it is possible to use other apparatus to give the relative movement between the screen and the screen printing frame, the preferred apparatus illustrated herein enjoins the simplicity of merely adding a pair of legs 81 to each of the screen tensioning devices 15 which may be of identical construction to that disclosed in U.S. Pat. No. 3,608,484. Manifestly, other tensioning devices may be adapted in various manners to practice the invention and fall within the appended claims.

While a preferred embodiment has been shown and described, it will be understood that there is no intent to limit the invention by such disclosure but, rather, it is intended to cover all modifications and alternate constructions following within the spirit and scope of the invention as defined in the appended claims.

What is claimed:

1. A screen fabric tensioning apparatus for stretching a fabric outwardly across a frame and for forcing one side screen frame member of the frame vertically against the fabric to facilitate securing of the fabric to the frame, said apparatus comprising:

a frame support means for supporting at least one side screen frame member of the frame, a fabric carrying means connectable to the fabric and movable relative to the frame support means and the side screen frame member to pull and stretch the fabric outwardly across the frame, power means to shift the fabric carrying means outwardly relative to the frame support means, and means for shifting the frame support means and the one screen frame member vertically with stretching of the fabric so that the screen frame member is moved into tight engagement with the fabric as the power means is operated.

2. An apparatus in accordance with claim 1 in which the said power means includes an inflatable tube pushing against the frame support means and the fabric carrying means which shifts outwardly relative to the screen frame member and pulls the fabric tightly against the upper side of the screen frame member.

3. An apparatus in accordance with claim 2 in which the means for shifting the frame support means vertically comprises engageable inclined surfaces on each of said frame support means and said fabric carrying means with the frame support means being moved upwardly as the fabric carrying means moves outwardly relative to the frame member.

4. An apparatus in accordance with claim 1 in which the fabric carrying means includes a pair of spaced legs for sliding horizontally along a surface and said legs mount the fabric carrying means and support means at a predetermined angle to the horizontal.

5. An apparatus in accordance with claim 4 in which the predetermined angle is about 20 degrees.

6. An apparatus for stretching a fabric across a frame and for forcing and moving upwardly one side member of the frame against the fabric to facilitate securing of the fabric to the frame, said apparatus comprising:

a fabric tensioning device including a support means for supporting the screen frame member and a fabric carrying means connected to the fabric to stretch the fabric outwardly across the screen frame member, slide surfaces on said support means and said fabric carrying means extending substantially the width of the frame and slideably engaged to guide the outward movement of the fabric carrying means to stretch the fabric without substantial rotation of the fabric carrying means relative to the support means, said slide surfaces being inclined at a predetermined angle to the horizontal, slideable supports supporting the tensioning device at a predetermined inclination to the screen frame and to the horizontal, and pneumatic power means for shifting the fabric carrying member and supports outwardly with the inclined slide surfaces shifting the support means and screen frame member upwardly simultaneously against the underside of the fabric with the outward movement and stretching of the fabric across the top of the screen frame member.

7. An apparatus in accordance with claim 6 in which said slideable supports comprises a pair of legs attached to the underside of the fabric tensioning device at spaced locations, said legs having horizontal flat bottom surfaces for sliding along a table.

8. An apparatus for stretching and pulling outwardly a fabric from a roll of fabric across a screen frame and for forcing and moving one side member of the frame upwardly against the fabric to facilitate securing of the fabric to the frame, said apparatus comprising:

a fabric tensioning device having a first portion connected to the one screen frame side member and a second fabric portion connectable to the fabric and being slideably outwardly relative to first support portion to stretch the fabric outwardly of the one side member, said second fabric portion having an upwardly facing groove into which the fabric may be positioned and a lock means positioned over the fabric in the groove and allowing the fabric in the groove to still be attached to the fabric roll, a fluid power means for forcing the second portion outwardly of the screen frame member to pull and stretch the fabric outwardly across the top of the one side member, and means for forcing the first portion and the screen frame side member upwardly against the fabric as the fabric is being pulled and stretched outwardly and downwardly by the second fabric portion.

9. An apparatus in accordance with claim 8 in which support flanges project horizontally from the first frame portion and underlie the frame member.

* * * * *